US010794053B2

(12) United States Patent
Wu et al.

(10) Patent No.: US 10,794,053 B2
(45) Date of Patent: Oct. 6, 2020

(54) REINFORCED COMPOUND CONCRETE BEAM-COLUMN JOINT CONTAINING DEMOLISHED CONCRETE LUMPS AND A CONSTRUCTION METHOD

(71) Applicant: SOUTH CHINA UNIVERSITY OF TECHNOLOGY, Guangdong (CN)

(72) Inventors: Bo Wu, Guangdong (CN); Jianbo Zang, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 16/341,447

(22) PCT Filed: Oct. 26, 2017

(86) PCT No.: PCT/CN2017/107724
§ 371 (c)(1),
(2) Date: Apr. 12, 2019

(87) PCT Pub. No.: WO2018/072759
PCT Pub. Date: Apr. 26, 2018

(65) Prior Publication Data

US 2020/0040564 A1 Feb. 6, 2020

(30) Foreign Application Priority Data

Oct. 17, 2016 (CN) ..... 2016 1 0903706

(51) Int. Cl.
*E04B 1/21* (2006.01)
*E04B 1/41* (2006.01)
(Continued)

(52) U.S. Cl.
CPC ..... *E04B 1/21* (2013.01); *E04B 1/41* (2013.01); *E04B 1/16* (2013.01); *E04B 1/58* (2013.01); *E04C 3/20* (2013.01); *E04G 21/00* (2013.01)

(58) Field of Classification Search
CPC ... E04B 1/04; E04B 1/21; E04B 1/215; E04B 1/41; E04B 1/16; E04B 1/58; E04B 1/20;
(Continued)

(56) References Cited

U.S. PATENT DOCUMENTS

2017/0051495 A1* 2/2017 Zavitz ..... E04B 1/215

FOREIGN PATENT DOCUMENTS

CA 2135066 C * 7/2007 ..... E04B 1/215
CN 101418629 4/2009
(Continued)

OTHER PUBLICATIONS

"International Search Report (Form PCT/ISA/210)", dated Jan. 25, 2018, with English translation thereof, pp. 1-5.

*Primary Examiner* — Babajide A Demuren
(74) *Attorney, Agent, or Firm* — JCIPRNET

(57) ABSTRACT

A reinforced compound concrete beam-column joint containing demolished concrete lumps and a construction method are disclosed. The steel strip stirrups configured to constrain column longitudinal reinforcements of the reinforced compound concrete column containing demolished concrete lumps and the steel connection sheets with grooves are arranged in joint at positions of the upper and lower beam longitudinal reinforcements of the reinforced compound concrete beam containing demolished concrete lumps. The steel strip stirrups abut against the column longitudinal reinforcements. The steel connection sheets are welded to the steel strip stirrups. One end of the short steel bars with threads at one end is welded into the grooves of the
(Continued)

steel connection sheets, and the other end is connected to the beam longitudinal reinforcement via a steel sleeve. The joint prevents the beam longitudinal reinforcements from passing through the joint and thus causing reinforcements congestion.

10 Claims, 2 Drawing Sheets

(51) Int. Cl.

| | |
|---|---|
| *E04B 1/16* | (2006.01) |
| *E04B 1/58* | (2006.01) |
| *E04C 3/20* | (2006.01) |
| *E04G 21/00* | (2006.01) |

(58) Field of Classification Search
CPC ..... E04C 3/20; E04C 5/165; E04C 5/0604; E04G 21/00
See application file for complete search history.

(56) References Cited

FOREIGN PATENT DOCUMENTS

| | | | | | |
|---|---|---|---|---|---|
| CN | 102864842 | | | 1/2013 | |
| CN | 204081087 | | | 1/2015 | |
| CN | 204282540 | | | 4/2015 | |
| CN | 106149873 | A | * | 11/2016 | |
| CN | 106545086 | | | 3/2017 | |
| CN | 108951886 | A | * | 12/2018 | |
| CN | 109162351 | A | * | 1/2019 | |
| DE | 2035474 | A1 | * | 1/1972 | ..... E04C 5/16 |
| EP | 1905909 | A2 | * | 4/2008 | ..... E04B 1/215 |
| EP | 2966232 | B1 | * | 1/2017 | ..... E04B 1/1912 |
| FR | 2599070 | A2 | * | 11/1987 | ..... E04B 1/98 |
| JP | 2010236217 | | | 10/2010 | |
| KR | 1663132 | B1 | * | 10/2016 | |
| KR | 2017027235 | A | * | 3/2017 | |
| KR | 2018122152 | A | * | 11/2018 | |
| WO | WO-2018074814 | A1 | * | 4/2018 | ..... E04C 3/20 |

* cited by examiner

REINFORCED COMPOUND CONCRETE BEAM-COLUMN JOINT CONTAINING DEMOLISHED CONCRETE LUMPS AND A CONSTRUCTION METHOD

CROSS-REFERENCE TO RELATED APPLICATION

This application is a 371 application of an international PCT application serial no. PCT/CN2017/107724, filed on Oct. 26, 2017, which claims priority to and the benefit of China Patent Application No. CN201610903706.8, filed on Oct. 17, 2016. The entirety of each of the above-mentioned patent applications is hereby incorporated by reference herein and made a part of this specification.

TECHNICAL FIELD

The present invention relates to the technical field of recycling waste concrete, and in particular, relates to a reinforced compound concrete beam-column joint containing demolished concrete lumps, and a construction method.

BACKGROUND

At present, since exploration of natural sand and stone destroys the environment and the reserves are dwindling, waste concrete, as a valuable "special resource", its recycle use is being more and more widely concerned at home and abroad. Compared with recycled coarse aggregate and recycled fine aggregate, adopting demolished concrete lumps with a larger size can greatly simplify the recycling process of the waste concrete.

Reinforced concrete structure has been extensively used in a diversity of engineering practice due to its favorable mechanical behavior and economical efficiency. Design of the reinforced concrete beam-column joint is critical to the rigidity, mechanical behavior and safety of the structure, and the convenience of the construction. "Strong column-weak beam" is an effective measure for achieving the overall anti-seismic performance of the structure. However, this design concept generally is not implemented in practical earthquakes, and on the contrary, it presents an unfavorable failure mode of "strong beam-weak column". Additionally, the reinforced concrete beam-column joint is a part where beam and column longitudinal reinforcements together with the densely distributed column stirrups in joint are densely converged. The reinforcements in the joint are densely aggregated, and this causes a great difficulty in pouring the demolished concrete lumps with a large size into the joint and the column. Therefore, a beam-column joint suitable for reinforced compound concrete which not only facilitates pouring the demolished concrete lumps but also has good anti-seismic performance is urgently designed.

SUMMARY

To overcome the disadvantages and defects of the prior arts, the present invention provides a reinforced compound concrete beam-column joint containing demolished concrete lumps and a construction method. The joint prevents beam longitudinal reinforcements from passing through the joint and thus causing reinforcements congestion, solves the problem of pouring large-size demolished concrete lumps into the joint and column, and achieves the objectives of "energy-saving, environmental friendliness and emission reduction". In addition, by manually weakening the bending resistant capability of the beam ends, a favorable failure mode of "strong column-weak beam" is ensured, such that the overall anti-seismic performance of the structure is enhanced.

The objectives of the present invention are achieved by the following technical solutions.

A reinforced compound concrete beam-column joint containing demolished concrete lumps comprises: reinforced compound concrete beam containing demolished concrete lumps, reinforced compound concrete column containing demolished concrete lumps, steel strip stirrups, steel connection sheets with grooves and short steel bars with threads at one end; wherein the steel strip stirrups are configured to constrain column longitudinal reinforcements of the reinforced compound concrete column containing demolished concrete lumps and the steel connection sheets with grooves are arranged in joint at positions of the upper and lower beam longitudinal reinforcements of the reinforced compound concrete beam containing demolished concrete lumps; the steel strip stirrups abut against the column longitudinal reinforcements of the reinforced compound concrete column containing demolished concrete lumps, and the steel connection sheets with grooves is welded to the steel strip stirrups; one end of the short steel bars with threads at one end is welded into the grooves of the steel connection sheets, and the other end of the short steel bars with threads at one end is connected to the beam longitudinal reinforcement of the reinforced compound concrete beam containing demolished concrete lumps via a steel sleeve; and the diameter of the short steel bars with threads at one end is less than the diameter of the beam longitudinal reinforcement of the reinforced compound concrete beam containing demolished concrete lumps.

Further, the interiors of the reinforced compound concrete beam containing demolished concrete lumps and the reinforced compound concrete column containing demolished concrete lumps comprise demolished concrete lumps and fresh concrete, wherein a mass ratio of the demolished concrete lumps to the fresh concrete is 1:4 to 1:1.

Further, the demolished concrete lumps are formed by demolishing old buildings, structures and roads after reinforcements being partially or totally removed, and the demolished concrete lumps have a characteristic size not less than 60 mm.

Further, the steel sleeve connection between the short steel bars with threads at one end and the beam longitudinal reinforcement of the reinforced compound concrete beam containing demolished concrete lumps is thread connection.

Further, the steel connection sheets with grooves are welded to the steel strip stirrups via fillet weld, the short steel bars with threads at one end are welded to the steel connection sheets with grooves via fillet weld, and the steel strip stirrups are formed by welding steel plates having the same thickness.

Further, the short steel bar with threads at one end has a length of 0.5 H to 1.5 H, H being a height of the reinforced compound concrete beam containing demolished concrete lumps.

A construction method of the reinforced compound concrete beam-column joint containing demolished concrete lumps as described above includes the following steps.

(1) Welding the steel connection sheets with grooves to the midst part of the steel strip stirrups in vertical direction, and welding the short steel bars with threads at one end to the steel connection sheets with grooves.

(2) Arranging column longitudinal reinforcements of the reinforced compound concrete column containing demolished concrete lumps, positioning column stirrups of the reinforced compound concrete column containing demolished concrete lumps and the steel strip stirrups welded with both the steel connection sheets with grooves and the short steel bars with threads at one end, spot welding the steel strip stirrups to the column longitudinal reinforcements of the reinforced compound concrete column containing demolished concrete lumps, tying the column stirrups of the reinforced compound concrete column containing demolished concrete lumps, and finishing template fabrication and installation of the reinforced compound concrete column containing demolished concrete lumps.

(3) Connecting the short steel bar with threads at one end to beam longitudinal reinforcements of the reinforced compound concrete beam containing demolished concrete lumps via the steel sleeve, tying the beam stirrups of the reinforced compound concrete beam containing demolished concrete lumps, and fabricating and installing template of the reinforced compound concrete beam containing demolished concrete lumps.

(4) Sufficiently wetting demolished concrete lumps in advance, pouring the fresh concrete with a thickness of 20 mm to 35 mm into the reinforced compound concrete column containing demolished concrete lumps, alternately pouring the demolished concrete lumps and fresh concrete into the reinforced compound concrete column containing demolished concrete lumps and sufficiently vibrating.

(5) Pouring the demolished concrete lumps into the reinforced compound concrete beam containing demolished concrete lumps at one time, and then pouring the fresh concrete and sufficiently vibrating.

Compared with the prior arts, the present invention has the following advantages and achieves the following technical effects.

(1) The joint prevents the beam longitudinal reinforcements from passing through the joint and thus causing reinforcements congestion, solves the problem of pouring large-size demolished concrete lumps into the joint and column, apparently improves the construction speed, and achieves the objectives of "energy-saving, environmental friendliness and emission reduction".

(2) By manually reducing the diameter of the short steel bar with threads at one end (i.e., the diameter is less than the diameter of the beam longitudinal reinforcement of the reinforced compound concrete beam containing demolished concrete lumps), a favorable failure mode of "strong column-weak beam" is ensured, such that the overall anti-seismic performance of the structure is enhanced.

(3) The welding between the steel strip stirrups and the steel connection sheets with grooves, and between the short steel bar with threads at one end and the steel connection sheets with grooves may be both processed in the factory. In this way, the welding quality is ensured, and the welding work at the construction site is obviously reduced, such that the construction speed is improved.

In these figures, 1 denotes the reinforced compound concrete column containing demolished concrete lumps; 2 denotes the steel connection sheets with grooves; 3 denotes the steel strip stirrups; 4 denotes the column longitudinal reinforcement; 5 denotes the column stirrup; 6 denotes the short steel bar with threads at one end; 7 denotes the steel sleeve; 8 denotes the beam stirrup; 9 denotes the reinforced compound concrete beam containing demolished concrete lumps; 10 denotes the beam longitudinal reinforcement; 11 denotes the demolished concrete lump, and 12 denotes the fresh concrete.

DETAILED DESCRIPTION

The present invention is further described in detail hereinafter with reference to specific embodiments and accompanying drawings. However, implementation or practice of the present invention is not limited to these embodiments.

Figure 1:
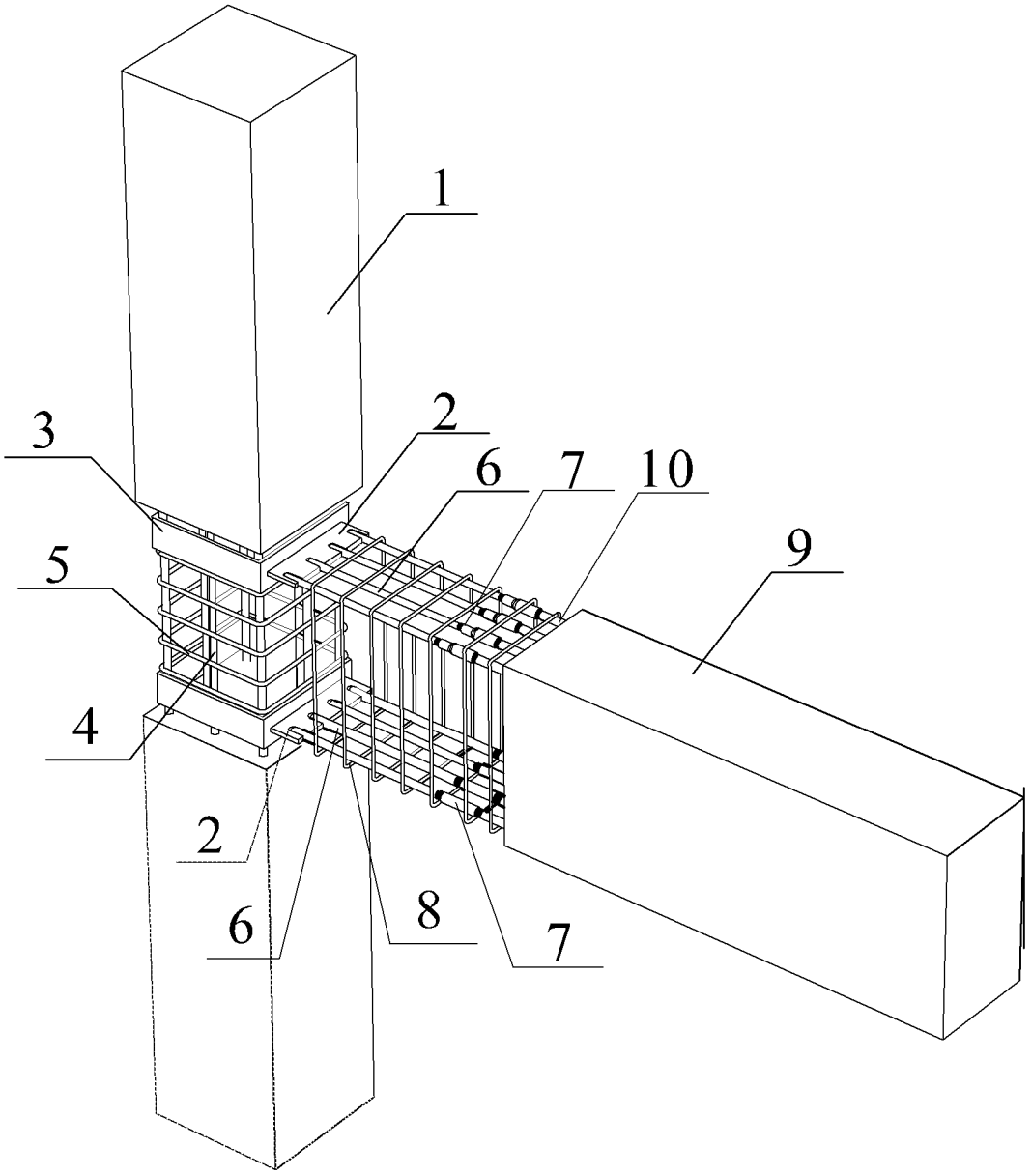
FIG. 1 is a schematic view of a reinforced compound concrete beam-column joint containing demolished concrete lumps according to the present invention.
Figure 2:
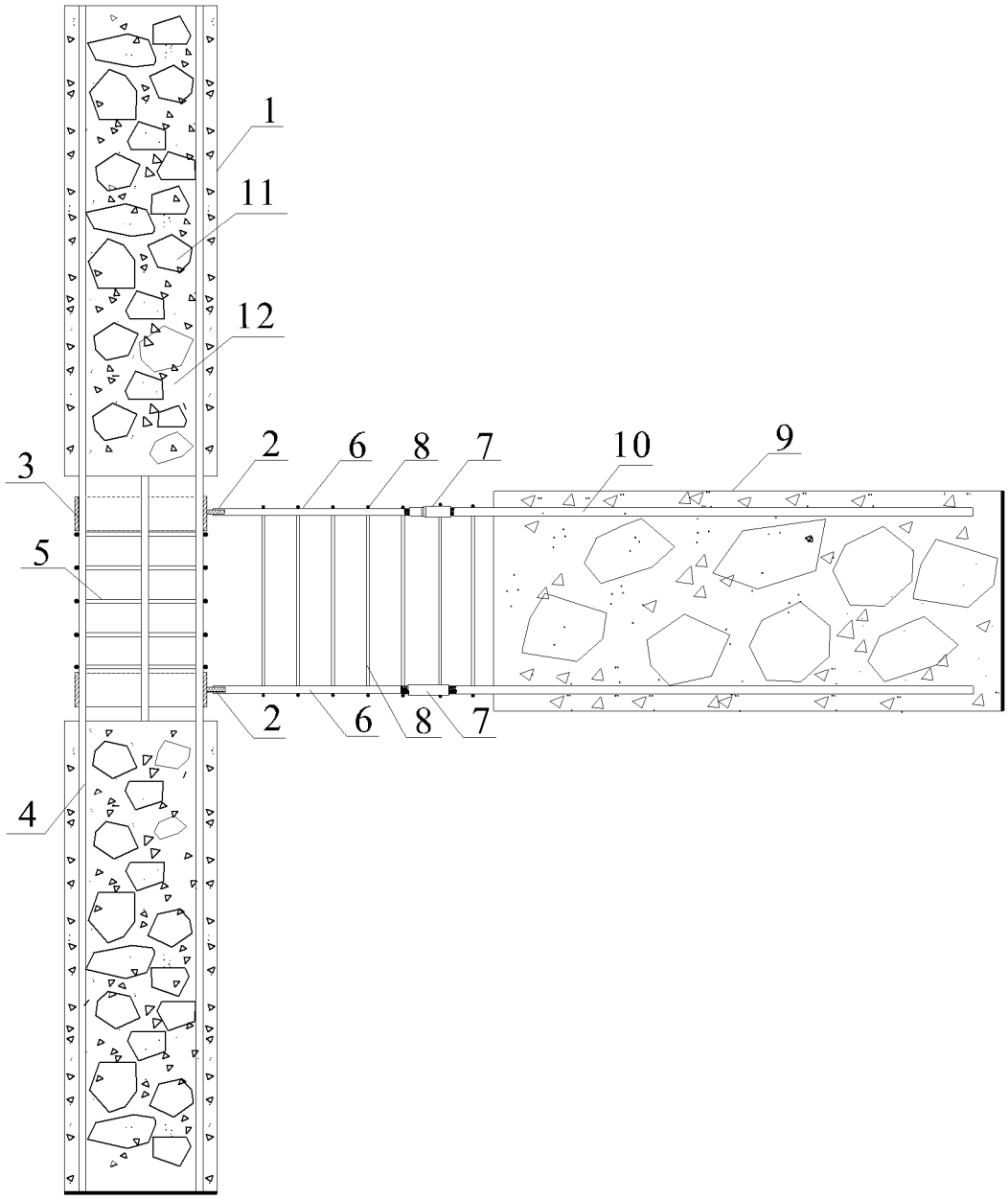
FIG. 2 is a vertical sectional view of the joint in FIG. 1.

As illustrated in FIG. 1 and FIG. 2, for clear exhibition of the joint and the beam ends details, the concrete in the joint and in the beam ends is not shown in FIG. 1 and FIG. 2. In this embodiment, the reinforced compound concrete beam-column joint containing demolished concrete lumps mainly comprises: reinforced compound concrete column containing demolished concrete lumps 1, reinforced compound concrete beam containing demolished lumps 9, steel strip stirrups 3, steel connection sheets 2 with grooves and short steel bar 6 with threads at one end; wherein the steel strip stirrups 3 are configured to constrain column longitudinal reinforcements 4 of the reinforced compound concrete column containing demolished concrete lumps 1 and the steel connection sheets 2 with grooves are arranged in joint at positions of the upper and lower beam longitudinal reinforcements 10 of the reinforced compound concrete beam containing demolished concrete lumps 9; the steel strip stirrups 3 abut against the column longitudinal reinforcements 4 of the reinforced compound concrete column containing demolished concrete lumps 1, and the steel connection sheets 2 with grooves are welded to the steel strip stirrups 3; one end of the short steel bars 6 with threads at one end are welded into the grooves of the steel connection sheets 2, and the other end of the short steel bar with threads at one end is connected to the beam longitudinal reinforcement 10 of the reinforced compound concrete beam containing demolished concrete lumps 9 via a steel sleeve 7; and the diameter of the short steel bar 6 with threads at one end is less than the diameter of the beam longitudinal reinforcement 10 of the reinforced compound concrete beam containing demolished concrete lumps 9.

In this embodiment, the reinforced compound concrete column containing demolished concrete lumps 1 has a cross sectional dimension of 450 mm×450 mm, and the steel strip stirrups in the column are formed by welding steel plates with a thickness of 10 mm.

In this embodiment, the reinforced compound concrete beam containing demolished concrete lumps 9 has a cross sectional dimension of 350 mm×600 mm, and the short steel bar 6 with threads at one end has a length of 1.0 H, wherein H is a height of the reinforced compound concrete beam containing demolished concrete lumps 9.

In this embodiment, the connection via the steel sleeve 7 between the short steel bar 6 with threads at one end and the beam longitudinal reinforcement 10 of the reinforced compound concrete beam containing demolished concrete lumps 9 is thread connection.

In this embodiment, the steel connection sheets 2 with grooves is welded to the steel strip stirrups 3 via fillet weld, and the short steel bar 6 with threads at one end is welded to the steel connection sheets 3 with grooves via fillet weld.

A construction method of the reinforced compound concrete beam-column joint containing demolished concrete lumps as described above includes the following steps.

(1) Welding the steel connection sheets 2 with grooves to the midst part of the steel strip stirrups 3 in the vertical direction, and welding the short steel bar 6 with threads on one end to the steel connection sheets 2 with grooves.

(2) Arranging column longitudinal reinforcement 4 of the reinforced compound concrete column containing demolished concrete lumps 1, positioning column stirrups 5 of the reinforced compound concrete column containing demolished concrete lumps 1 and the steel strip stirrups 3 welded with both the steel connection sheets 2 with grooves and the short steel bar 6 with threads at one end, spot welding the steel strip stirrups 3 to the column longitudinal reinforcement 4 of the reinforced compound concrete column containing demolished concrete lumps 1, tying the column stirrups 5 of the reinforced compound concrete column containing demolished concrete lumps 1, and finishing template fabrication and installation of the reinforced compound concrete column containing demolished concrete lumps 1.

(3) Connecting the short steel bar 6 with threads at one end to the beam longitudinal reinforcement 10 of the reinforced compound concrete beam containing demolished concrete lumps 9, tying beam stirrups 8 of the reinforced compound concrete beam containing demolished concrete lumps 9, and fabricating and installing template of the reinforced compound concrete beam containing demolished concrete lumps 9.

(4) Sufficiently wetting demolished concrete lumps 11 in advance, pouring the fresh concrete 12 with a thickness of 20 mm to 35 mm into the reinforced compound concrete column containing demolished concrete lumps 1, alternately pouring the demolished concrete lumps 11 and fresh concrete 12 into the reinforced compound concrete column containing demolished concrete lumps 1 and sufficiently vibrating.

(5) Pouring the demolished concrete lumps 11 into the reinforced compound concrete beam containing demolished concrete lumps 9 at one time, and then pouring the fresh concrete 12 and sufficiently vibrating.

In this embodiment, the steel strip stirrups 3 and the steel connection sheets 2 with grooves both employ a steel of Q345B, and the electrode adopts E50, and the welding flux adopts F5014, and the welding quality is grade one. Both the beam longitudinal reinforcement 10 of the reinforced compound concrete beam containing demolished concrete lumps 9 and the column longitudinal reinforcement 4 of the reinforced compound concrete column containing demolished concrete lumps 1 employ HRB400 hot-rolled steel bar, the beam horizontal reinforcement 8 of the reinforced compound concrete beam containing demolished concrete lumps 9 and the column horizontal reinforcement 5 of the reinforced compound concrete column containing demolished concrete lumps 1 both employ HPB400 hot-rolled steel bar, the fresh concrete 12 has a strength grade of C35, the demolished concrete lumps 11 has a strength grade of C30, and a mass ratio of the demolished concrete lumps 11 to the fresh concrete 12 is 1:2. As described above, the present invention may be better practiced.

Described above are only exemplary embodiments of the present invention, and the implementation or practice of the present invention is not limited by the above embodiments. Any change, modification, replacement, combination, and simplification made within the spirit and principle of the present invention should be equivalent replacements, and shall be included within the protection scope of the present invention.

What is claimed is:

1. A reinforced compound concrete beam-column joint containing demolished concrete lumps, comprising: a reinforced compound concrete beam containing the demolished concrete lumps, a reinforced compound concrete column containing the demolished concrete lumps, steel strip stirrups, steel connection sheets with grooves, and short steel bars with threads at a first end; wherein the steel strip stirrups are configured to constrain column longitudinal reinforcements of the reinforced compound concrete column containing the demolished concrete lumps and the steel connection sheets with the grooves are arranged in joint at positions of an upper and a lower beam longitudinal reinforcements of the reinforced compound concrete beam containing the demolished concrete lumps; the steel strip stirrups abut against the column longitudinal reinforcements of the reinforced compound concrete column containing the demolished concrete lumps, and the steel connection sheets with the grooves are welded to the steel strip stirrups; a second end of the short steel bars with the threads at the first end is welded into the groove of the steel connection sheets, and the first end of the short steel bars with the threads at the first end is connected to the beam longitudinal reinforcement of the reinforced compound concrete beam containing the demolished concrete lumps via a steel sleeve; and a diameter of the short steel bars with the threads at the first end is less than a diameter of the beam longitudinal reinforcement of the reinforced compound concrete beam containing the demolished concrete lumps, wherein the steel connection sheets with the grooves are welded to the steel strip stirrups via a fillet weld, the short steel bars with the threads at the first end are welded to the steel connection sheets with the grooves via the fillet weld, and the steel strip stirrups are formed by welding steel plates having the same thickness.

2. The reinforced compound concrete beam-column joint containing the demolished concrete lumps according to claim 1, wherein interiors of the reinforced compound concrete beam containing the demolished concrete lumps and the reinforced compound concrete column containing the demolished concrete lumps comprise the demolished concrete lumps and fresh concrete, wherein a mass ratio of the demolished concrete lumps to the fresh concrete is 1:4 to 1:1.

3. The reinforced compound concrete beam-column joint containing the demolished concrete lumps according to claim 2, wherein the demolished concrete lumps are formed by demolishing old buildings, structures and roads after reinforcements being partially or totally removed, and the demolished concrete lumps have a characteristic size not less than 60 mm.

4. The reinforced compound concrete beam-column joint containing the demolished concrete lumps according to claim 1, wherein a steel sleeve connection between the short steel bars with the threads at the first end and the beam longitudinal reinforcement of the reinforced compound concrete beam containing the demolished concrete lumps is a thread connection.

5. The reinforced compound concrete beam-column joint containing the demolished concrete lumps according to claim 1, wherein the short steel bars with the threads at the first end has a length of 0.5 H to 1.5 H, H being a height of the reinforced compound concrete beam containing the demolished concrete lumps.

6. A construction method of the reinforced compound concrete beam-column joint containing demolished concrete lumps as defined in claim 1, the construction method comprising:

(1) welding the steel connection sheets with the grooves to a midst part of the steel strip stirrups in a vertical direction, and welding the short steel bars with the threads at first end to the steel connection sheets with the grooves;

(2) arranging column longitudinal reinforcements of the reinforced compound concrete column containing the demolished concrete lumps, positioning column stirrups of the reinforced compound concrete column containing the demolished concrete lumps and the steel strip stirrups welded with both the steel connection sheets with the grooves and the short steel bars with the threads at the first end, spot welding the steel strip stirrups to the column longitudinal reinforcements of the reinforced compound concrete column containing the demolished concrete lumps, tying the column stirrups of the reinforced compound concrete column containing the demolished concrete lumps, and finishing template fabrication and installation of the reinforced compound concrete column containing the demolished concrete lumps;

(3) connecting the short steel bars with the threads at the first end to beam longitudinal reinforcement of the reinforced compound concrete beam containing the demolished concrete lumps via the steel sleeve, tying beam stirrups of the reinforced compound concrete beam containing the demolished concrete lumps, and fabricating and installing template of the reinforced compound concrete beam containing the demolished concrete lumps;

(4) sufficiently wetting the demolished concrete lumps in advance, pouring the fresh concrete with a thickness of 20 mm to 35 mm into the reinforced compound concrete column containing the demolished concrete lumps, alternately pouring the demolished concrete lumps and fresh concrete into the reinforced compound concrete column containing the demolished concrete lumps and sufficiently vibrating; and (5) pouring the demolished concrete lumps into the reinforced compound concrete beam containing the demolished concrete lumps at one time, and then pouring the fresh concrete and sufficiently vibrating.

7. A construction method of the reinforced compound concrete beam-column joint containing demolished concrete lumps as defined in claim 2, the construction method comprising:

(1) welding the steel connection sheets with the grooves to a midst part of the steel strip stirrups in a vertical direction, and welding the short steel bars with the threads at first end to the steel connection sheets with the grooves;

(2) arranging column longitudinal reinforcements of the reinforced compound concrete column containing the demolished concrete lumps, positioning column stirrups of the reinforced compound concrete column containing the demolished concrete lumps and the steel strip stirrups welded with both the steel connection sheets with the grooves and the short steel bars with the threads at the first end, spot welding the steel strip stirrups to the column longitudinal reinforcements of the reinforced compound concrete column containing the demolished concrete lumps, tying the column stirrups of the reinforced compound concrete column containing the demolished concrete lumps, and finishing template fabrication and installation of the reinforced compound concrete column containing the demolished concrete lumps;

(3) connecting the short steel bars with the threads at the first end to beam longitudinal reinforcement of the reinforced compound concrete beam containing the demolished concrete lumps via the steel sleeve, tying beam stirrups of the reinforced compound concrete beam containing the demolished concrete lumps, and fabricating and installing template of the reinforced compound concrete beam containing the demolished concrete lumps;

(4) sufficiently wetting the demolished concrete lumps in advance, pouring the fresh concrete with a thickness of 20 mm to 35 mm into the reinforced compound concrete column containing the demolished concrete lumps, alternately pouring the demolished concrete lumps and fresh concrete into the reinforced compound concrete column containing the demolished concrete lumps and sufficiently vibrating; and (5) pouring the demolished concrete lumps into the reinforced compound concrete beam containing the demolished concrete lumps at one time, and then pouring the fresh concrete and sufficiently vibrating.

8. A construction method of the reinforced compound concrete beam-column joint containing demolished concrete lumps as defined in claim 3, the construction method comprising:

(1) welding the steel connection sheets with the grooves to a midst part of the steel strip stirrups in a vertical direction, and welding the short steel bars with the threads at first end to the steel connection sheets with the grooves;

(2) arranging column longitudinal reinforcements of the reinforced compound concrete column containing the demolished concrete lumps, positioning column stirrups of the reinforced compound concrete column containing the demolished concrete lumps and the steel strip stirrups welded with both the steel connection sheets with the grooves and the short steel bars with the threads at the first end, spot welding the steel strip stirrups to the column longitudinal reinforcements of the reinforced compound concrete column containing the demolished concrete lumps, tying the column stirrups of the reinforced compound concrete column containing the demolished concrete lumps, and finishing template fabrication and installation of the reinforced compound concrete column containing the demolished concrete lumps;

(3) connecting the short steel bars with the threads at the first end to beam longitudinal reinforcement of the reinforced compound concrete beam containing the demolished concrete lumps via the steel sleeve, tying beam stirrups of the reinforced compound concrete beam containing the demolished concrete lumps, and fabricating and installing template of the reinforced compound concrete beam containing the demolished concrete lumps;

(4) sufficiently wetting the demolished concrete lumps in advance, pouring the fresh concrete with a thickness of 20 mm to 35 mm into the reinforced compound concrete column containing the demolished concrete lumps, alternately pouring the demolished concrete lumps and fresh concrete into the reinforced compound concrete column containing the demolished concrete lumps and sufficiently vibrating; and (5) pouring the demolished concrete lumps into the reinforced compound concrete beam containing the demolished concrete lumps at one time, and then pouring the fresh concrete and sufficiently vibrating.

9. A construction method of the reinforced compound concrete beam-column joint containing demolished concrete lumps as defined in claim 4, the construction method comprising:

(1) welding the steel connection sheets with the grooves to a midst part of the steel strip stirrups in a vertical direction, and welding the short steel bars with the threads at first end to the steel connection sheets with the grooves;

(2) arranging column longitudinal reinforcements of the reinforced compound concrete column containing the demolished concrete lumps, positioning column stirrups of the reinforced compound concrete column containing the demolished concrete lumps and the steel strip stirrups welded with both the steel connection sheets with the grooves and the short steel bars with the threads at the first end, spot welding the steel strip stirrups to the column longitudinal reinforcements of the reinforced compound concrete column containing the demolished concrete lumps, tying the column stirrups of the reinforced compound concrete column containing the demolished concrete lumps, and finishing template fabrication and installation of the reinforced compound concrete column containing the demolished concrete lumps;

(3) connecting the short steel bars with the threads at the first end to beam longitudinal reinforcement of the reinforced compound concrete beam containing the demolished concrete lumps via the steel sleeve, tying beam stirrups of the reinforced compound concrete beam containing the demolished concrete lumps, and fabricating and installing template of the reinforced compound concrete beam containing the demolished concrete lumps;

(4) sufficiently wetting the demolished concrete lumps in advance, pouring the fresh concrete with a thickness of 20 mm to 35 mm into the reinforced compound concrete column containing the demolished concrete lumps, alternately pouring the demolished concrete lumps and fresh concrete into the reinforced compound concrete column containing the demolished concrete lumps and sufficiently vibrating; and (5) pouring the demolished concrete lumps into the reinforced compound concrete beam containing the demolished concrete lumps at one time, and then pouring the fresh concrete and sufficiently vibrating.

10. A construction method of the reinforced compound concrete beam-column joint containing demolished concrete lumps as defined in claim 5, the construction method comprising:

(1) welding the steel connection sheets with the grooves to a midst part of the steel strip stirrups in a vertical direction, and welding the short steel bars with the threads at first end to the steel connection sheets with the grooves;

(2) arranging column longitudinal reinforcements of the reinforced compound concrete column containing the demolished concrete lumps, positioning column stirrups of the reinforced compound concrete column containing the demolished concrete lumps and the steel strip stirrups welded with both the steel connection sheets with the grooves and the short steel bars with the threads at the first end, spot welding the steel strip stirrups to the column longitudinal reinforcements of the reinforced compound concrete column containing the demolished concrete lumps, tying the column stirrups of the reinforced compound concrete column containing the demolished concrete lumps, and finishing template fabrication and installation of the reinforced compound concrete column containing the demolished concrete lumps;

(3) connecting the short steel bars with the threads at the first end to beam longitudinal reinforcement of the reinforced compound concrete beam containing the demolished concrete lumps via the steel sleeve, tying beam stirrups of the reinforced compound concrete beam containing the demolished concrete lumps, and fabricating and installing template of the reinforced compound concrete beam containing the demolished concrete lumps;

(4) sufficiently wetting the demolished concrete lumps in advance, pouring the fresh concrete with a thickness of 20 mm to 35 mm into the reinforced compound concrete column containing the demolished concrete lumps, alternately pouring the demolished concrete lumps and fresh concrete into the reinforced compound concrete column containing the demolished concrete lumps and sufficiently vibrating; and (5) pouring the demolished concrete lumps into the reinforced compound concrete beam containing the demolished concrete lumps at one time, and then pouring the fresh concrete and sufficiently vibrating.

* * * * *